US005142264A

United States Patent [19]

Radford et al.

[11] Patent Number: 5,142,264

[45] Date of Patent: Aug. 25, 1992

[54] HIGH ENERGY ABSORBING VARISTOR

[75] Inventors: Kenneth C. Radford, North Huntingdon, Pa.; Robert G. Johnson; Andrew S. Sweetana, Jr., both of Bloomington, Ind.

[73] Assignee: Electric Power Research Institute, Inc., Palo Alto, Calif.

[21] Appl. No.: 452,265

[22] Filed: Dec. 15, 1989

[51] Int. Cl.[5] ..... H01C 7/10

[52] U.S. Cl. ..... 338/21

[58] Field of Search ..... 338/21, 20; 264/61, 264/104; 252/512

[56] References Cited

U.S. PATENT DOCUMENTS 4,169,071 9/1979 Eda et al. ..... 338/21 X 4,918,421 4/1990 Lawless et al. ..... 338/21

*Primary Examiner*—Marvin M. Lateef

*Attorney, Agent, or Firm*—Flehr, Hohbach, Test, Albritton & Herbert

[57] ABSTRACT

A method for producing varistors having high energy absorption. The high energy absorption is achieved by combining predetermined quantities of $Bi_2O_3$, BaO, $SiO_2$ and $Sb_2O_3$ with ZnO to produce a mixture which is sintered to produce a varistor disc having high energy absorption.

3 Claims, 1 Drawing Sheet

HIGH ENERGY ABSORBING VARISTOR

BACKGROUND OF THE INVENTION

1. Field of the Invention

The invention relates to varistors and more particularly to varistors having high energy absorption.

2. Summary of the Prior Art

A wide variety of varistors are known in the prior art. The prior art clearly indicates a continuing effort to improve the energy absorption of varistor discs. High performance prior art varistors frequently utilize $Bi_2O_3$ in concentrations higher than 1.0 mole percent. This is a strategic and expensive material thus adding significantly to the cost of the varistors. Varistors having improved high temperature stability and using lower concentration of this expensive material are desirable.

A prior art patent search was performed prior to preparing this patent application. The prior art cited during this search is discussed below.

U.S. Pat. No. 4,724,416, discloses a varistor which includes $Bi_2O_3$ in combination with other elements. A varistor including 5 to 30 weight percent of $B_2O_3$ and 70 to 95 weight percent $SiO_2$ is disclosed in U.S. Pat. No. 4,551,268. U.S. Pat. No. 4,527,146, discloses a varistor including bismuth, cobalt, manganese, antimony and nickel. Varistors including a variety of rare earth elements are illustrated in U.S. Pat. No. 4,160,748.

The use of $GeO_2$ and $Bi_2O_3$ is illustrated in U.S. Pat. No. 3,953,373. A method for making varistor discs is disclosed in U.S. Pat. No. 3,905,006. U.S. Pat. No. 3,689,863, discloses a varistor having up to 10 mole percent BeO. Varistors having up to 50 mole percent $SiO_2$ are disclosed by U.S. Pat. No. 3,872,582. U.S. Pat. No. 4,460,494, discloses a varistor using Cr,Si and $SiO_2$.

The above patents illustrate the wide variety of mixtures and processes used to form prior art varistor discs. These patents are also believed to illustrate the absence of any unified theory to predict the performance of specific varistors. That is, each new mixture must be experimentally verified in order to predict its performance.

SUMMARY OF THE INVENTION

Varistors are formed by combining ZnO with smaller amounts of other materials to form a powdered mixture. Portions of the mixture are pressed to form a disc which is sintered.

Performance of a varistor is critically dependent on the mixture and the sintering process. $Bi_2O_3$, $Sb_2O_3$, $SiO_2$ and BaO are material frequently added to the predominantly ZnO mixture to improve the performance of the varistor disc. The disclosed invention provides an improved varistor formed by combining critical concentrations of selected ones of these materials with appropriate amounts of ZnO to form the mixture.

DETAILED DESCRIPTION

Figure 1:
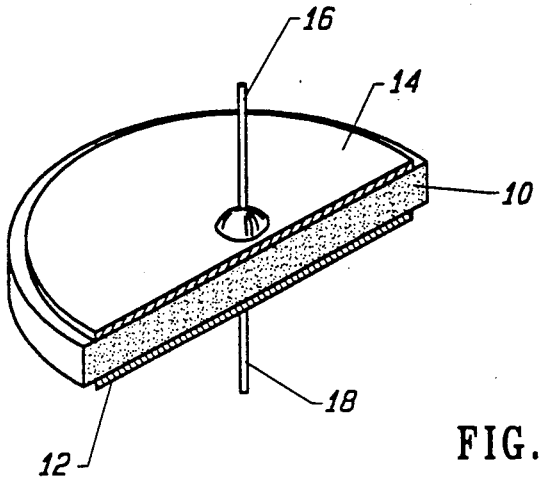
FIG. 1 is a drawing partially in cross section, of a typical varistor.

A typical varistor is illustrated in FIG. 1. The varistor includes a disc 10 having electrodes, 12 and 14, affixed to opposite sides thereof. Leads, 16 and 18, provide means for imposing an electrical voltage across the varistor disc 10 to subject the disc 10 to a voltage stress. As is well-known in the art, the characteristics of the varistor are primarily determined by the disc 10.

Figure 2:
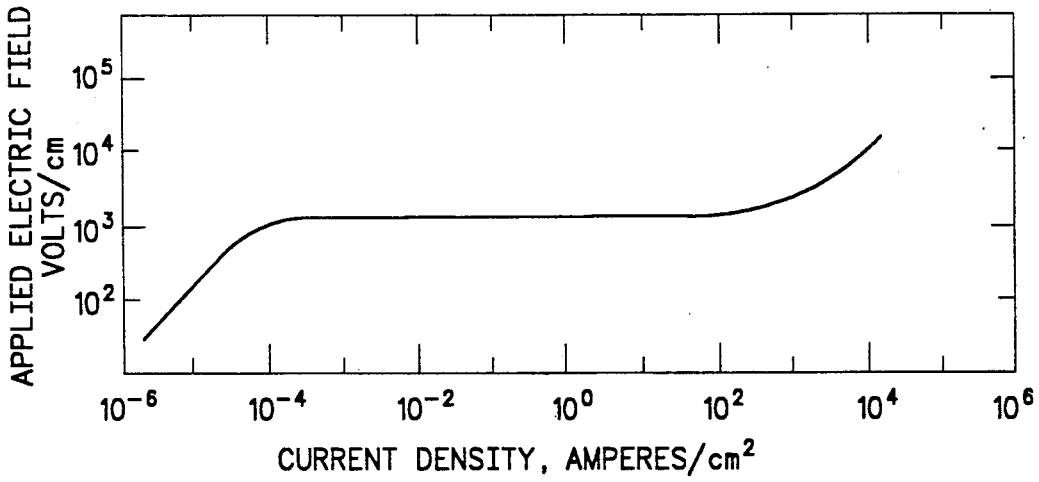
FIG. 2 is a drawing illustrating the characteristics of a typical varistor.

The voltage/current characteristic of a typical varistor disc is illustrated in FIG. 2. When the applied electric field (voltage stress) is sufficiently low, the voltage/current characteristic is substantially linear. As the voltage stress approaches a critical value, the voltage/current characteristic becomes very non-linear with a small increase in voltage resulting in a large increase of current.

Typically varistors operate on line continuously and are usually subjected to a voltage stress between 0.4 and 0.8 $E_{0.5}$. ($E_{0.5}$ is the voltage stress corresponding to a current density of 0.5 milliampere per square centimeter.) As the applied voltage increases due to voltage surges, the increased voltage stress results in a rapid increase in current, thus absorbing sufficient energy to limit the magnitude of the voltage.

As described above, varistor surge protectors function to absorb energy due to transient high voltage or high current conditions. The energy transient, which may range from a few microseconds to milliseconds in duration, depending on the source, causes the temperature of the varistor to increase due to the increase in energy dissipation. The energy is absorbed in the zinc oxide grain and dissipated as heat, with the amount of energy absorbed by a disc or a specific volume being directly related to the grain size.

Considerable effort is presently being devoted to increasing the energy absorption of varistor discs. Such an increase can reduce the size of the disc required for a particular application. Typically, state of the art varistor discs absorb about 100–200 J/cc. If this absorption of the varistor could be increased to in the range of 1000 J/cc, the number of varistor discs required for a particular application could be reduced by a factor of 5 to 7, with significant savings in both materials and manufacturing costs.

It is also well known in the art that at an elevated temperatures, the resistive current at a constant voltage stress irreversibly increases. Thus it is essential to control the operating temperature of the varistor disc to obtain adequate operating life.

In forming varistor discs the materials are prepared as a powdered mixture and sintered. It is known that improvements in energy absorption are achievable by increasing the sintering temperature. However, some critical materials used to improve other varistor parameters are volatile at higher temperatures, thus significantly limiting the improvements in absorption achievable using higher sintering temperatures.

$Bi_2O_3$ is a material frequently included in varistor discs to improve energy absorption. Significant improvements in energy absorption can also be achieved by altering the concentration of the $Bi_2O_3$. Typical prior art varistors utilize $Bi_2O_3$ concentrations in excess of 1 mole percent. This is particularly beneficial when the $Sb_2O_3$ and $SiO_2$ are also used in concentrations greater than 1 mole percent. However, $Bi_2O_3$ is an expensive and strategic material, thus reducing the requirement for this material would be extremely beneficial. The disclosed invention provides varistor discs having improved energy absorption. The improved performance is achieved by using a mixture containing $Bi_2O_3$, $Sb_2O_3$, $SiO_2$ and BaO in critical concentrations.

Due to the chemistry of varistor discs, slight alterations of mixture have the capability to drastically alter various parameters of the varistor disc. The state of the art is such that the effect of changes in the composition of the mixture can not be predicted. Consequently, the improved performance of varistor discs comprising the invention was experimentally verified as subsequently described.

Specifically, in determining and verifying the critical concentrations of the materials comprising the mixture in accordance with the current invention, varistor discs were made in the usual manner in which ZnO in combination with $Bi_2O_3$, $Sb_2O_3$, $SiO_2$, and low concentrations of additives including $Co_3O_4$, $MnO_2$, B, K and $Al_2O_3$ were combined to form the mixture. These materials were milled, spray-dried and pressed into discs, which were sintered under a standard treatment of two hours at 1300° C., after which the discs were lapped, annealed for 2 hours at 600° C. and electrically tested. The finished discs were tested for thermal stability at 250' C., at a voltage stress $0.7E_{0.5}$. This test is a conventional method of evaluating the performance of the varistor at high energy absorption levels, for example 1000 J/cc. The test results for different concentrations of the critical materials are in the table below, in which the room temperature leakage current measured at $0.7E_{0.5}$, the stability of the discs with time at 250° C., and the energy absorption measured at $1.1E_{0.5}$ are given.

| COMP | BaO m/o | $Bi_2O_3$ m/o | $Sb_2O_3$ m/o | $SiO_2$ m/o | $E_{0.5}$ V/cm | RT iR uA/cm$^2$ | STAB ENERGY Mins | STAB ENERGY J/cm$^3$ |
|---|---|---|---|---|---|---|---|---|
| 925 | 0.5 | 1.0 | 1.5 | 0.5 | 1191 | 3.6 | 308 | 869 |
| 940 | 0.5 | 0.75 | 1.5 | 0.5 | 1294 | 3.7 | 350 | 475 |
| 942 | 0.25 | 1.0 | 1.0 | 0.5 | 1242 | 3.9 | 44 | 594 |
| 947 | 0 | 1.0 | 1.5 | 0.5 | 1564 | 5.1 | 122 | 400 |
| 950 | 0.25 | 1.25 | 2.0 | 1.0 | 1408 | 2.9 | 190 | 489 |
| 951 | 0.5 | 1.0 | 1.0 | 0.5 | 1102 | 4.3 | 350 | 407 |
| 952 | 0.5 | 1.25 | 1.0 | 0.5 | 1058 | 4.5 | 350 | 404 |
| 953 | 0.5 | 1.0 | 1.5 | 1.0 | 1380 | 3.1 | 305 | 679 |
| 955 | 0.75 | 1.0 | 1.5 | 0.5 | 1294 | 2.5 | 350 | 659 |
| 956 | 1.0 | 1.0 | 1.5 | 0.5 | 1258 | 1.8 | 350 | 492 |
| 959 | 0.5 | 1.0 | 1.5 | 0.1 | 1021 | 44.9 | 1 | 606 |
| 961 | 0.5 | 0.875 | 1.5 | 0.5 | 1499 | 6.0 | 2 | 558 |
| 962 | 0.25 | 1.0 | 1.5 | 0.5 | 1167 | 4.0 | 280 | 1019 |

Based on the above experimental results, it is clear that 1.0 M/O $Bi_2O_3$ and 1.5 M/O $Sb_2O_3$ are necessary for maximizing energy absorption of the varistor disc. These results also show that very low levels of $SiO_2$ are detrimental to all electrical properties, whereas 1.0 M/O improved the resistive losses but reduced the energy absorption. These results also clearly demonstrate that combining 0.25 M/O of BaO with 1.0 M/O of $Bi_2O_3$, 1.5 M/O $Sb_2O_3$, 0.5 M/O $SiO_2$ and smaller non-critical amounts of the other materials previously discussed, significantly increases the energy absorption of the varistor disc. Specifically, this mixture coupled with the above described sintering cycle produces varistors having an energy absorption greater than 100C J/cc. This is a significant increase in the energy absorption as compared to prior art varistors. A varistor disc constructed using mixtures including these critical concentrations provides the improved performance coupled with a lowered concentration of expensive materials such as $Bi_2O_3$.

We claim:

1. A method for forming a varistor disc by sintering a mixture in accordance with a selected sintering cycle, including the steps of:

a) combining selected materials in predetermined concentrations to form said mixture, said mixture including substantially 1.0 mole percent of $Bi_2O_3$, substantially 0.25 mole percent of BaO, substantially 0.5 mole percent of $SiO_2$ and substantially 1.5 mole percent of $Sb_2O_3$;

b) pressing selected amounts of said mixture to form disc; and c) sintering said disc at a temperature of 1300° C.; and d) annealing said disc at a temperature of 600° C.

2. A varistor disc having high dissipation and high stability formed by sintering a mixture comprising primarily ZnO in combination with:

a) $Bi_2O_3$ in a concentration of substantially 1.0 mole percent;

b) BaO in a concentration of substantially 0.25 mole percent;

c) $SiO_2$ in a concentration of substantially 1.5 mole percent.

d) $Sb_2O_3$ in a concentration of substantially 1.5 mole percent.

3. A varistor disc in accordance with claim 2 wherein said mixture also includes $Co_3O_4$, $MnO_2$, B, K and $Al_2O_3$.

* * * * *